United States Patent [19]

Dessauer et al.

[11] 4,191,403

[45] Mar. 4, 1980

[54] DONOR MATERIAL FOR CARBONLESS COPYING

[75] Inventors: Guido Dessauer, Düsseldorf-Gerresheim; Kurt Riecke, Kempen; Ferdinand Land, Viersen, all of Fed. Rep. of Germany

[73] Assignee: Feldmuhle Aktiengesellschaft, Düsseldorf, Fed. Rep. of Germany

[21] Appl. No.: 941,801

[22] Filed: Sep. 13, 1978

[30] Foreign Application Priority Data

Sep. 29, 1977 [DE] Fed. Rep. of Germany ..... 2743800

[51] Int. Cl.[2] ..... B41M 5/22

[52] U.S. Cl. ..... 282/27.5; 106/21; 106/24; 252/316; 427/150; 427/151; 428/307; 428/323; 428/327; 428/402; 428/914

[58] Field of Search ..... 106/21, 24; 282/27.5; 427/150, 151, 180; 428/17, 22, 307, 913, 914, 323, 327, 402, 411, 537; 252/316

[56] References Cited

U.S. PATENT DOCUMENTS

| | | | |
|---|---|---|---|
| 3,900,671 | 8/1975 | Evans | 282/27.5 X |
| 3,996,060 | 12/1976 | Johnson | 282/27.5 X |
| 3,996,061 | 12/1976 | Johnson | 282/27.5 X |

*Primary Examiner*—Bruce H. Hess

*Attorney, Agent, or Firm*—Toren, McGeady and Stanger

[57] ABSTRACT

In a donor material for carbonless copying which mainly consists of a carrier sheet and a multiplicity of frangible microcapsules containing a suitable dye precursor in a liquid medium and secured to one face of the sheet, spacer particles of soybean protein are interspersed in a relatively small amount between the microcapsules and project beyond the microcapsules away from the carrier sheet to protect the microcapsules against premature fracture.

5 Claims, No Drawings

DONOR MATERIAL FOR CARBONLESS COPYING

This invention relates to carbonless copying, and particularly to an improved donor material for a copying system in which a colored or black image is produced from a dye precursor in a donor material and a reactant in an acceptor material when contact between the two materials is established.

In widely used systems for carbonless copying, the donor material is a sheet of paper one major face of which carries a multiplicity of frangible microcapsules in a thin layer bonded to the paper face. The microcapsules enclose suitable dye precursors in a liquid medium. The acceptor material may be another paper sheet coated with an active clay which is capable of converting the dye precursor to a colored or black dye if the sheets are superimposed on each other, and the microcapsules are fractured under pressure applied by a typewriter or another writing implement. It has not been practical to manufacture the microcapsules to exacting specifications so that they would break only at the relatively high pressure of a typewriter key or a ball pen, but remain intact under normal handling stresses. It has been common practice, therefore, to intersperse the microcapsules with so-called stilt or spacer particles which project from the supporting sheet beyond the microcapsules and thus absorb impact less powerful than that of writing implement.

As disclosed, for example, in U.S. Pat. Nos. 3,625,736 and 3,996,060, pulverulent starch, cellulose and small plastic beads have been used with some success for protecting the exposed microcapsules, but they are not entirely satisfactory in their effects and are often inconvenient to apply to the supporting sheet in a fluid coating composition also containing the microcapsules as a dispersed, solid phase.

The known pulverulent materials are difficult to bond to a substrate of paper or any other economically acceptable material, such as a plastic web. The powders tend to be released from the known donor materials as a fine dust which may foul a typewriter or other recording machine.

Microcapsules are most economically applied to a substrate in the form of a coating composition, normally an aqueous liquid in which a suitable binder is dissolved. The spacer particles are dispersed in the same liquid. The amount of starch or cellulose powder that needs to be incorporated in the coating composition to provide adequate protection for the microcapsules in the coated sheet is high enough to make the coating composition too viscous for application by high speed methods.

Starch particles tend to swell in contact with water, and thereby further to interfere with the coating process. It has been proposed to substitute particles of starch ethers or starch esters for native starch particles, but the starch derivatives are much more costly and have not found general acceptance for this reason.

The primary object of this invention is the provision of a donor material of the type described in which the microcapsules are adequately protected against premature fracture by spacers which can be formulated for concentrated coating compositions of relatively low viscosity and which adhere firmly to the coated substrate.

It has been found that solid, discrete particles of vegetal proteins insoluble in water satisfy these requirements and have other advantages that will become apparent as the disclosure proceeds. Among the vegetal proteins presently available to us, soybean protein is less expensive than protein of potatoes, corn, wheat, and of other legumes, and many commercial grades of soybean protein are of high purity which does not significantly vary from batch to batch. While particles of proteins from other vegetal sources are water-insoluble and otherwise effective as spacers interspersed with the microcapsules on donor material for carbonless copying, soybean protein offers a combination of advantages not jointly available in other vegetal proteins. The invention, therefore, will be described with primary reference to soybean protein, it being understood that other water-insoluble vegetal proteins may be substituted where special conditions warrant.

Soybean protein is insoluble in plain water for all practical purposes due, at least in part, to its high molecular weight which also accounts for the inability of soybean protein to absorb water and to swell to a relevant extent. Wheat protein, by comparison, swells so much that it is advisable to add formaldehyde as a cross linking agent to coating compositions of the invention in which the vegetal protein is derived from wheat. Glyoxal or glutaraldehyd may be used also.

Where soybean protein of adequate purity is not available commercially, it is readily prepared by extracting crude, defatted soybean meal with alkaline aqueous solutions and acidifiying the extract.

The size of the spacer particles must be matched carefully to that of the microcapsules for best results. The average particle size of the proteinaceous material should not be smaller than twice nor greater than three times the average particle size of the microcapsules. When the microcapsules employed vary in diameter between 2 and 10$\mu$ and average 6$\mu$, the spacer particles should vary between no less than 4 and no more than 30$\mu$ and average 12 to 18$\mu$. If the microcapsules vary from 5 to 20$\mu$ and average 12.5$\mu$, the protein particles may vary between 10 and 60$\mu$ and should average 25 to 37.5$\mu$. The desired fractions are readily recovered from the commercially available product or from the precipitate prepared in the manner described above by conventional air classification. The particle size of the precipitated, purified soybean protein may be influenced to some extent by gradually adding the alkaline extract in an acidic precipitating solution while agitating the mixture with a stirrer whose speed may be adjusted. There is a distinct relationship between the rate of agitation and the preponderant particle size of the precipitate, the relationship varying with other parameters so that it needs to be established empirically for any specific set of conditions.

Regardless of the manner in which they were prepared, particles of soybean protein in the relevant size range of less than 100$\mu$ are approximately spherical, ellipsoidal, or otherwise rounded and free from sharp edges and corners that may cause premature fracture of microcapsules by contact.

The amount of vegetal protein particles that may be used to advantage on donor material of the type described above may vary between 10 and 50 percent of the weight of the externally dry capsules in which the dye precursor composition is sealed. Aqueous coating compositions containing soybean protein particles have most desirable processing characteristics and yield best protection for the microcapsules if the weight of the protein particles amounts to 12 to 25 percent of the microcapsule weight. The same preferred limits are also applicable to other vegetal proteins. The coating composition needs to contain a suitable binder, such as dissolved polyvinyl alcohol or a synthetic resin dispersion, and preferably is adjusted to a pH value at which the solubility and swelling tendency of the protein is at its minimum, that is, the isoelectric point characteristic of the protein.

Spacers of vegetal protein, particularly soybean protein, are more resistant to low pressure than other spacer material used heretofore, without interfering with fracture of the microcapsules under concentrated high pressure, such as that of a writing implement. The reason for this effect, which will be illustrated below, is not yet fully understood, but is consistent with the assumption of specifically beneficial elastic properties of the protein particles.

The amount of binder needed for securing protein particles to a paper sheet or other substrate is much lower than the amount of binder required for bonding cellulose or starch particles to the substrate with equal strength. Amounts of binders which cannot prevent dusting of cellulose or starch spacers completely prevent release of protein particles.

Fluid coating compositions containing protein particles as prospective spacers are more stable then otherwise comparable compositions containing cellulose or starch particles which tend to settle in storage. Coating compositions of acceptable viscosity prepared with protein spacer particles may have a much higher content of solid matter than equally viscous compositions containing starch or cellulose. The solids content is inversely proportional to the solvent or water content, and thus to the necessary drying time. Coating compositions of the invention dry much faster than equivalent known coating compositions and thus permit operation of coating equipment at higher speeds.

The following Examples are further illustrative of coating compositions of the invention and of donor material prepared therewith in comparison with otherwise closely analogous compositions and donor materials employing conventional spacer particles.

EXAMPLE 1

7.6 g Polyvinyl alcohol (PVA) of an intermediate degree of hydrolysis and 3.1 g fully hydrolized PVA were dissolved in enough water to make 107 g of a 10% solution to which 0.05 g of a commercial anti-foaming agent was added during disolution of the PVA. 25 g Soybean protein having a particle size of 20–40$\mu$ and averaging 30$\mu$ was gradually added to the solution with stirring, and ultimately 333 g of a 30% dispersion of microcapsules, that is, 100 g microcapsules on an externally dry basis.

The microcapsule dispersion was a commercial product. The microcapsules ranged in size from 10$\mu$ to 20$\mu$ and averaged 14$\mu$. They contained crystal violet lactone and benzoyl leucomethylene blue as dye precursors in a terphenyl solvent.

The coating composition so produced had a pH of 6.8 and was applied to one face of a good grade of coating base stock free from wood fibers and weighing 41 g/m$^2$ by means of an airknife coating machine at a rate to make the weight of the coating 6 g/m$^2$ after conventional drying. This material will be referred to below as donor paper A.

Donor paper B was prepared from 90 g PVA solution and 20 g soybean protein in an otherwise unchanged procedure.

Donor paper C was produced as paper A, but the soybean protein was replaced by an equal weight of native starch powder (Keystar 2000, manufactured by AWEBE-Amylum, Veendam, Netherlands) having a particle size of 20–60$\mu$, and averaging 30–40$\mu$.

Donor paper D differed from paper B by containing 20 g starch as used in paper C instead of an equal weight of soybean protein.

In preparing donor paper E, the soy protein in paper A was replaced by 44 g finely ground cellulose powder (Arbozell B 600/50, made by J. Rettenmayer und Sohne, Holzmuehle, Germany) having an average thickness of 30$\mu$.

The several papers were subjected to tests generally accepted in this art for evaluating performance of donor sheets under low and high contact pressure, under abrasive stresses, for bonding strength, and for sharpness of line reproduction.

In a contact pressure apparatus (made by Durner, Germany), strips of each donor paper, 24 cm$\times$4.7 cm, were placed face to face over similar strips of a commercial acceptor paper, and the pair was passed at 2 m/sec. under an aluminum cylinder loaded to 20 kp or 70 kp while supported on a carriage by a rubber mat having a Shore A hardness of 70. The roller pressure of 20 kp corresponds to unfavorable conditions of handling in which the microcapsules are preferred to remain intact, while the roller pressure of 70 kp is similarly analogous to that applied by a weakly struck typewriter key.

The acceptor paper then was separated from the donor sheet, and its surface was measured for reflectance of white light as compared with reflectance prior to the test. The difference of the two values divided by the initial value and multiplied by 100 was calculated as "percent contrast." The contrast values obtained are listed in the attached Table.

As is evident from the Table, the two papers A, B of the invention were superior to the papers C, D, E employing conventional spacer particles in preventing fracture of microcapsules at relatively low contact pressure without significant loss in color development at marginally strong pressure.

Circular sheets of the five donor papers, 8 cm in diameter, were superimposed on correspondingly shaped and dimensioned sheets of the afore-described acceptor paper. The two paper layers were placed between two foam rubber disks having a diameter of 5.7 cm and coaxially superimposed at a pressure of 625 p. The lower disk was rotated for 10 seconds at 100 RPM. The equipment necessary for this so-called Ohser abrasion test is commercially available from Sartorius.

The acceptor sheets were tested for contrast in the manner described above, and the five donor papers A–E gave the values of percent contrast also listed in the Table. The donor sheets of the invention are at least equal to the best conventional sample E and superior to samples C and D.

Adhesion of the coating materials to the paper substrate was tested by placing a transparent plastic tape 3 cm wide and carrying a pressure sensitive adhesive on the coated side of each donor sheet under uniform gentle pressure, and then peeling the tape from the sheet. The tape was placed on a sheet of the acceptor material used in the preceding tests, and the combined materials were passed between the rollers of a calender at a line pressure of 125 kp/cm. Any microcapsules picked up by the tape from the donor sheet were crushed between the calender rollers, and the resulting color of the accepter sheet was measured in a % contrast as in the tests described above. The results listed in the Table indicate significantly better adhesion of microcapsules in donor material of the invention as compared to the conventional materials.

In a test for sharpness or definition of copies produced by the several donor papers, letter size sheets of each donor paper were assembled with sheets of the same acceptor material of eight pairs of sheets, and each stack was imprinted in an automatic electric typewriter with rows and columns of lower-case letters x. The eighth carbonless copy was withdrawn from each stack, and the average widths of the copied lines was measured in microns to three significant figures.

The results of the measurements in the Table show the great superiority of the donor materials of the invention to otherwise similar sheets employing starch, and measurable superiority to cellulose powder.

TABLE

| | A | B | C | D | E |
|---|---|---|---|---|---|
| Contact pressure, 20 kp, % | 6.8 | 5.8 | 9.7 | 11.4 | 7.8 |
| 70 kp, % | 18.3 | 20 | 18.3 | 23.2 | 21.5 |
| Abrasion test, % | 5.4 | 4.7 | 10.7 | 17.3 | 5.3 |
| Adhesion test, % | 0.5 | 2.2 | 4.8 | 4.5 | 4 |
| Definition test, μ | 531 | 578 | 640 | 606 | 534 |

EXAMPLE 2

An aqueous 20% PVA solution was prepared from 13 parts almost fully hydrolyzed PVA and 0.7 part PVA of intermediate degree of saponification. 68.5 Parts of the PVA solution were mixed sequentially with 0.07 part antifoaming agent, 25 parts soy protein having a particle size of 20 to 40μ, and 312.5 parts of a 32% microcapsule dispersion, corresponding to 100 parts microcapsules on an externally dry basis, all parts being by weight. The resulting coating composition had a solids content of 34.5% and a Brookfield viscosity at 100 RPM of 210 cp.

Another coating composition was prepared in an analogous manner, but 44 parts finely ground cellulose powder (as described in Example 1) was used instead of 25 parts soy protein, and the finished mixture was diluted with water to a solids content of 32%. It still had a viscosity of 286 cp.

Although the amount of cellulose particles in the comparison test was higher than the amount of soybean protein, its protective effect was lower, as evidenced by the Table in Example 1, but the coating solution containing cellulose was more viscous, requiring it to be diluted with water so that the coating solution had a lower concentration and accordingly required a reduced coating rate to enable the added water to evaporate and the coating to dry.

EXAMPLE 3

Crosslinking of soybean protein: 25 g of a soybean protein as described in Example 1, 10 g of a 37% formaldehyde solution and 144 g water were mixed by stirring. A dispersion of low viscosity was obtained. After stirring for one hour, the dispersion was divided in two parts. While one of them was dewatered mechanically immediately by means of vacuum, the other part was stirred 5 hours longer. It then was dewatered in the same manner. After dewatering the percentage of solids was determined in a usual manner by holding samples of each part in a laboratory drying oven for 24 hours at 104° C.

PREPARATION OF COATING COMPOSITIONS.

Three coating compositions were prepared. Coating composition A contained soybean protein particles without any treatment, while coating composition B contained soybean protein, which had been treated for 1 hour and C for 6 hours by the cross-linking process described above.

84 g of 30% starch-solution (Avebe, manufactured by AWEBE-Amylum, Veendam, Netherlands) was prepared and 12.5 g untreated soybean protein was added. 0.3 g Commercial defoamer, 3 g calciumcarbonate and ultimately 125 g of a 40% dispersion of microcapsules was added. The microcapsules contained crystal violet lactone and benzoyl leucomethylene blue as dye precursors disolved in a terphenyl solvent. The finished mixture was diluted with water to a solids content of 38%. It had a pH of 6.8 and a Brookfield viscosity at 100 RPM of 310 cp. This mixture will be referred to as composition A.

A second coating composition B was prepared in an analogous manner using so much dewatered soybean protein—treated with formaldehyde for 1 hour—as was necessary to provide 12.5 g bone dry soybean protein in the mixture. The resulting composition was not diluted, its solids content was 38%, it had a pH of 6.7 and a Brookfield viscosity of 208 cp.

Coating composition C was similar to coating composition B, however the soybean protein treated 1 hour was replaced by the soybean protein which had been treated for 6 hours. The solids content was 38%. It had a pH of 6.7 and a Brookfield viscosity of 170 cp.

The values of viscosity clearly show that the viscosity of coating compositions depends on the time of treatment. The best result was obtained with coating composition C.

Papers located with composition A, B and C showed results comparable with other papers of the invention donor paper tests described in Example 1.

EXAMPLE 4

Wheat protein particles having a particle size of 25–45μ and averaging 30μ were treated with formaldehyde for 72 hours in a process similar to that described in Example 3. The high amount of water soluble substances in wheat protein required a longer time of crosslinking to reduce the swelling of wheat protein particles sufficiently.

Coating composition D was produced in a manner analogous to that described in Example 3 for coating composition A, but the untreated soybean protein was replaced by an equal weight of untreated wheat protein as described above.

In a coating composition E the untreated wheat protein was replaced by an equal weight of crosslinked wheat protein as described above.

Coating compositions D and E had a solids content of 38% and a pH of 6.8.

Brookfield viscosity at 100 RPM: D=510 cp; E=440 cp

It should be understood, of course, that the foregoing disclosure relates only to preferred embodiments of the invention, and that it is intended to cover all changes and modifications of the Examples of the invention herein chosen for the purpose of the disclosure which do not constitute departures from the spirit and scope of the invention set forth in the appended claims.

What is claimed is:

1. In a donor material for carbonless copying including a carrier sheet, a multiplicity of frangible microcapsules secured to one major face of said sheet, each microcapsule containing a dye precursor in a liquid medium, and discrete spacer particles interposed between said microcapsules and projecting beyond said microcapsules away from said face for protecting the microcapsules against premature fracture, the improvement which resides in said spacer particles consisting essentially of a vegetal protein insoluble in water and amounting to 10 to 50% of the weight of said microcapsules, the average size of said particles being between two and three times the average size of said microcapsules.

2. In a material as set forth in claim 1, said protein being soybean protein.

3. In a donor material as set forth in claim 1, said vegetal protein being partly cross-linked by formaldehyde.

4. The donor material of claim 1 wherein the microcapsule size varies between a diameter of 2 and 10 microns and the average diameter is 6 microns and the spacer particles vary between the diameter of 4 to 30 microns and the average size is 12 to 18 microns.

5. The donor material of claim 1 wherein the microcapsule size varies between a diameter of 5 to 20 microns and the average diameter is 12.5 microns and the spacer particles vary between a diameter of 10 to 60 microns and the average size is 25 to 37.5 microns.

* * * * *